United States Patent [19]

Ueberreiter

[11] Patent Number: 4,778,063

[45] Date of Patent: Oct. 18, 1988

[54] DEVICE FOR TESTING AND SORTING ELECTRONIC COMPONENTS

[76] Inventor: Ekkehard Ueberreiter, Drosselweg 14, D-8201 Raubling, Fed. Rep. of Germany

[21] Appl. No.: 921,434

[22] Filed: Oct. 22, 1986

[30] Foreign Application Priority Data

Nov. 11, 1985 [DE] Fed. Rep. of Germany ..... 3539965

[51] Int. Cl.[4] ..... B07C 5/344

[52] U.S. Cl. ..... 209/573; 324/158 F; 414/403

[58] Field of Search ..... 209/571, 573, 574, 909; 324/73 R, 73 AT, 73 PC, 158 F; 414/403, 404, 419, 421

[56] References Cited

U.S. PATENT DOCUMENTS

| | | | |
|---|---|---|---|
| 3,308,977 | 3/1967 | Cochran et al. | 414/404 X |
| 3,716,786 | 2/1973 | Gearin | 324/158 F |
| 3,727,757 | 4/1973 | Boissicat | 209/573 |
| 3,896,935 | 7/1975 | Hjelle et al. | 209/573 |
| 4,124,132 | 11/1978 | Pennings | 414/403 |
| 4,234,418 | 11/1980 | Boissicat | 209/542 |
| 4,500,246 | 2/1985 | Janisiewicz et al. | 414/403 X |
| 4,506,213 | 3/1985 | O'Connor | 324/158 F X |
| 4,588,092 | 5/1986 | Moechnig et al. | 209/573 |
| 4,618,305 | 10/1986 | Cedrone et al. | 414/403 |
| 4,651,090 | 3/1987 | Heigl | 324/158 F |

FOREIGN PATENT DOCUMENTS

| | | | |
|---|---|---|---|
| 0166448 | 1/1986 | European Pat. Off. | 324/158 F |
| 2855913 | 6/1980 | Fed. Rep. of Germany . | |
| 3340182 | 5/1985 | Fed. Rep. of Germany | 209/573 |
| 0225882 | 8/1985 | Fed. Rep. of Germany | 324/158 F |
| 56-168566 | 12/1981 | Japan | 324/73 AT |
| 58-96258 | 6/1983 | Japan | 324/158 F |

OTHER PUBLICATIONS

"*Container for Chip Carrier Assemblies*", Edmond, *IBM Technical Disclosure Bulletin*, vol. 14, No. 3, Aug. 1971.

"Module Test and Handling Apparatus";*IBM Technical Disclosure Bulletin*; vol. 16, No. 11, pp. 3653-3654; L. D. House; Apr. 1974.

*Primary Examiner*—Robert B. Reeves
*Assistant Examiner*—Edward M. Wacyra
*Attorney, Agent, or Firm*—Scully, Scott, Murphy & Presser

[57] ABSTRACT

To reduce manual work by an operator filling and unloading a device for testing and sorting electronic components it is suggested that a cassette carriage carrier (8) with a cassette carriage (10) displaceable therein, be placed in front of the input magazine (2). The cassette carriage (10) carries a cassette (11), on which a large number of magazine rods (12) are arranged side by side. The magazine rods (12) are displaceable and arranged on a plane which extends perpendicularly to the plane of the magazine channels of the input magazine (2) of the device (1). In the same way there can be provision for a cassette carriage carrier (8*a*) with a cassette (10*a*) and a cassette (11*a*) as well as the magazine rods (12*a*) attached to it in connection with the output magazine (6) of the device (1).

7 Claims, 3 Drawing Sheets

DEVICE FOR TESTING AND SORTING ELECTRONIC COMPONENTS

The invention relates to a device according to the preamble of claim 1.

A device of this nature is known. On this known device the input magazine is displaceable perpendicular to the plane formed by the magazine channels. The magazine channels are worked on one after the other, i.e. the input magazine is in each case pushed forward one magazine channel width, whenever the components of a magazine channel have been separated and delivered to the testing unit. The output magazine of the known device is stationary. The transfer of the components tested by the testing unit to the selected magazine channel of the output magazine assigned to a sorting class takes place with a shuttle which is movable transversely to the magazine channels of the output magazine and which in each case removes a tested component from the testing unit and delivers it to the selected magazine channel. The shuttle then travels back again to the discharge opening of the testing unit.

The loading of the magazine channels of the input magazine with untested components as well as the removal of the tested components from the magazine channels of the output magazine has been manual up to now. In the case of the input magazine a magazine rod filled with components is, therefore, attached to the respective input of the magazine channel of the input magazine, so that the components can slide from the magazine rod into the magazine channel mentioned as a result of the inclination. The removal of the tested components from the magazine channels of the output magazine takes place analogously. Here in each case an empty magazine rod is attached to the exit of the magazine channel so that the components can slide from the magazine channel onto the empty magazine rod as a result of the inclination.

The underlying object of the invention is to improve the device of the kind described above to the effect that the manual work of filling and emptying the device to be undertaken by an operator is reduced.

The object is achieved according to the invention by the features given in the characterising part of claim 1.

In connection with the input magazine it is now possible to refill immediately the magazine channel of the input magazine which has just been worked through, as new components are delivered to it from a magazine rod of the cassette. The cassette carriage on the cassette carriage carrier can also be moved into a position in which a magazine rod still filled corresponds to the magazine channel of the input magazine just emptied. With a displaceable input magazine the transfer of components from magazine rods of the cassette to magazine channels of the input magazine can in this way take place at a fixed point. This proves especially advantageous if the input magazine and the testing unit are arranged in a gasfilled climatic chamber. The climatic chamber is fed with either heated or cooled gas. Particularly cooled gas must be kept under excess pressure in the climatic chamber. This is because freezing would otherwise occur in the climatic chamber. However, the gas under excess pressure should if at all possible not escape, or, in other words, those unavoidable openings of the climatic chamber, through which gas can escape, should be kept as small as possible. Such an unavoidable opening is the place of delivery of the components to the input magazine. Since, as already mentioned, this point remains unchanged, and therefore lies at a fixed point, the entrance opening must at all events be the size of a component.

If the capacity for delivery of components is to be increased further, several cassettes can be arranged side by side on a cassette carriage, in the course of which an additional possibility of movement must be provided for the cassettes on the cassette carriage.

If a cassette carriage carrier with a cassette carriage is to be used in connection with a fixed output magazine, there is the possibility of arranging several cassette carriers with cassette carriages in a parallel fashion so that each of them corresponds to a particular magazine channel of the output magazine.

The above described developments of the features of the invention according to claim 1 are the object of claims 2 and 4.

Other developments, the advantages of which are seen in the description of the embodiment, are covered in claims 5 to 11.

An embodiment of the invention is hereinafter described with the help of the drawings, in which.

Figure 1:
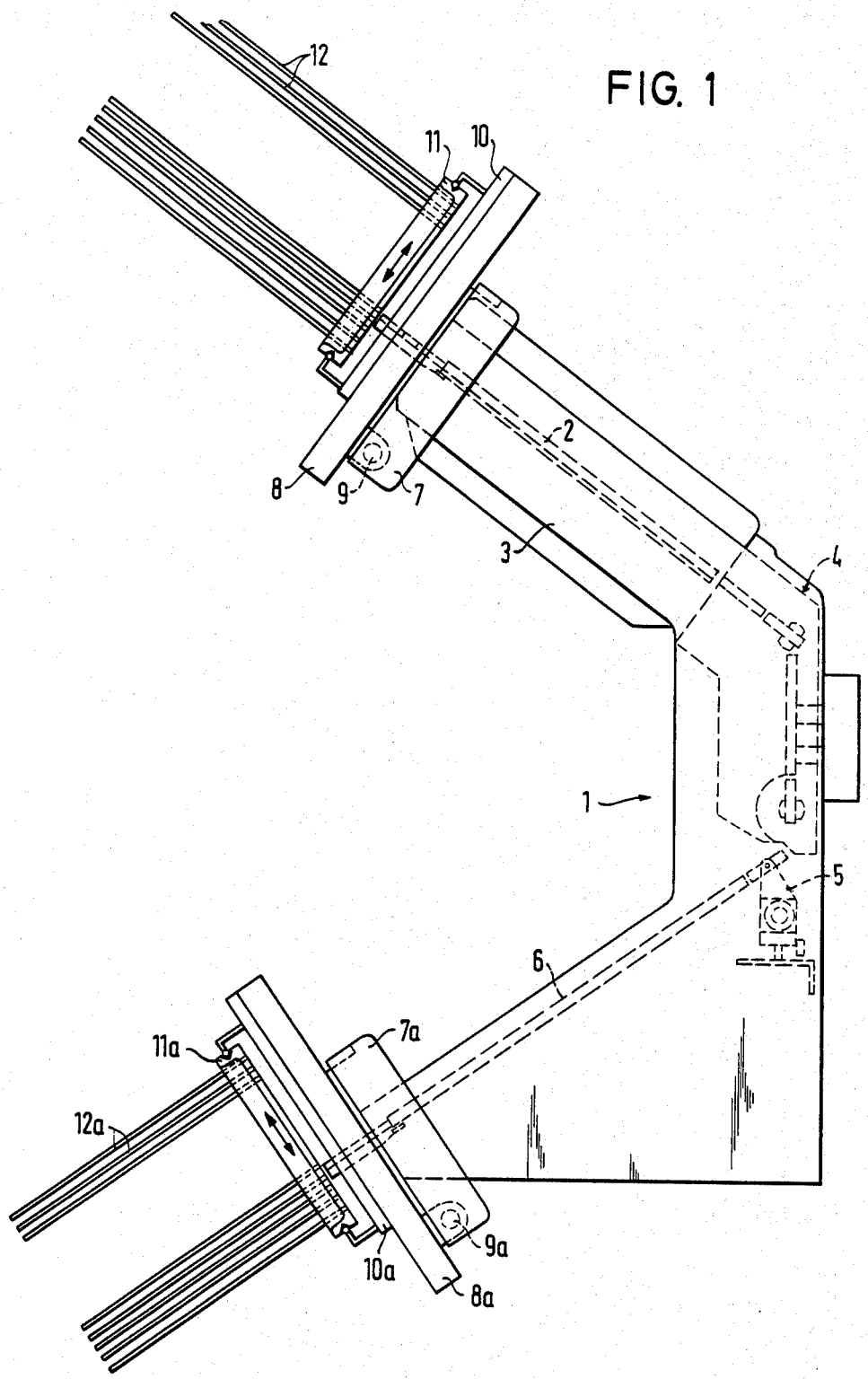
FIG. 1 shows a schematic side view of a device for testing and sorting electronic components, having a cassette carriage carrier with cassette carriage, cassette and magazine rods, connected at the input as well as at the output.

In FIG. 1, 1 designates a device for testing and sorting IC's. This has an input magazine 2, which is provided with a multiplicity of magazine channels running parallel and arranged at an incline. The magazine channels are arranged one behind the other perpendicular to the plane of the drawing. The input magazine 2 is movable perpendicular to the plane of the drawing in plane defined by the magazine channels. The input magazine 2 is arranged in a climatic chamber 3 which is filled with climatised gas under pressure. A testing unit 4 is attached to the input magazine. Once separated, the untested components are delivered one after the other to the testing unit 4 from a magazine channel of the input magazine brought into alignment with the input of the testing unit. The components are then tested in the testing unit and assigned to a sorting class. The motor of a movable shuttle 5 is steered with the corresponding sorting signal, which shuttle in each case removes a tested component from the testing unit 4 and delivers it to a magazine channel of a fixed output magazine 6. The output magazine 6 has a multiplicity of parallel magazine channels, which lie on a plane which runs perpendicular to the plane of the drawing. The channels of the output magazine 6 are also arranged at an incline, so that the components slide down under gravitational force. The same applies to the magazine channels of the input magazine 2.

Two carrier cheeks 7 are attached to the side walls of the device 1 in the region of the input magazine 2, between which cheeks a pivot shaft 9 extends. A cassette carriage carrier 8 sits on this pivot shaft 9, and itself carries a cassette carriage 10, which is displaceable, in the directions of the double arrow, on the cassette carriage carrier. The cassette carriage 10 carries an exchangeable cassette 11, in which there is also multiplicity of magazine rods (12) arranged in such a way that they are exchangeable.

There are also six lateral carrier cheeks 7*a* fixed on the output of the device 1 in the region of the output magazine 6, and between which cheeks a pivot shaft 9*a* extends. A cassette carriage carrier 8*a* is pivotally fixed to this and has a cassette carriage 10*a* which is also displaceable in the directions of the double arrow. The cassette carriage 10*a* carries a cassette 11*a* with magazine rods 12*a*. The conditions here are completely analogous to those of the cassette carriage carrier with cassette carriage at the input of the device. Only one of these attachments will therefore be described hereinafter.

Figure 2:
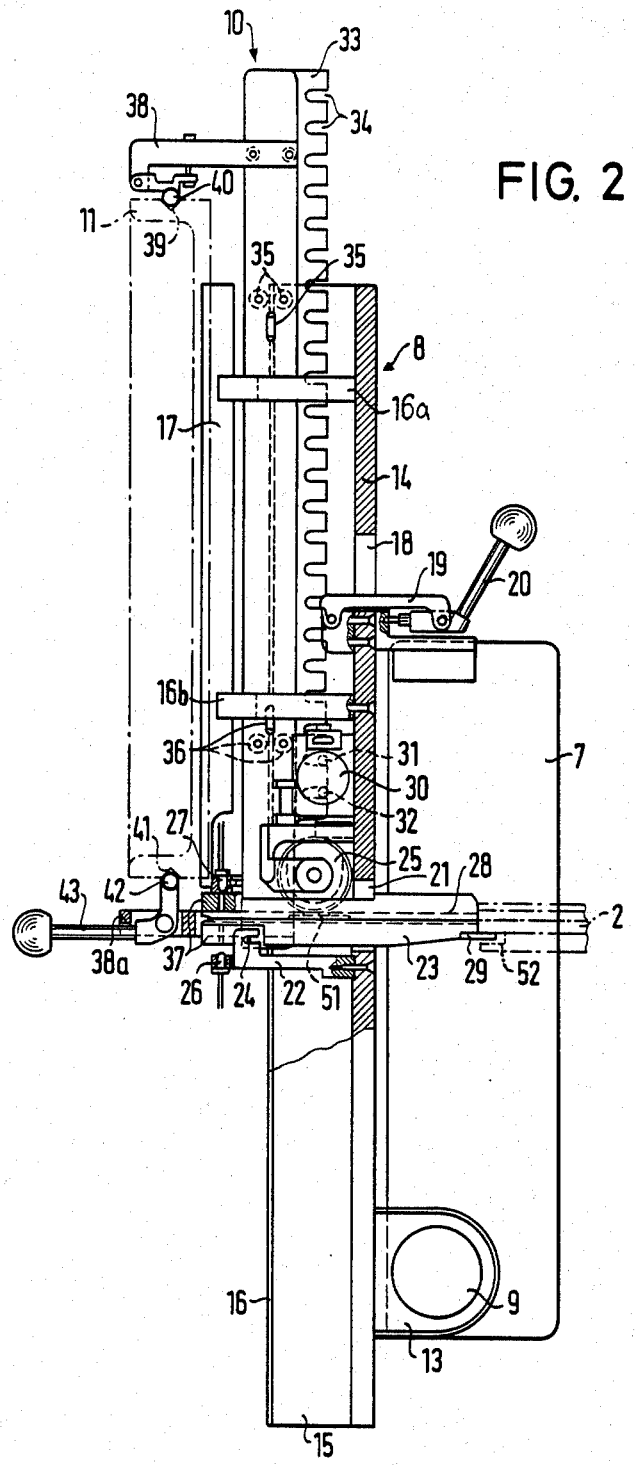
FIG. 2 shows an enlarged representation of the cassette carriage carrier, cassette carriage and cassette.

FIG. 2 shows the carrier cheek 7, the cassette carriage carrier 8, the cassette carriage 10, and the cassette 11 in enlarged form. The cassette carriage carrier 8 is pivotally fixed to the pivot shaft 9 with joint plates 13. The joint plates 13 (only one of which is visible in FIG. 2) extend from a mounting plate 14. Two side walls 15 are fixed onto the mounting plate 14 (only one of which is visible in FIG. 2). Guide rails 16 extend inwardly from the side walls 15. The cassette carriage 10 runs along these guide rails 16 with its attached guide rollers 35, 36.

On the mounting plate 14 of the cassette carriage carrier 8 there are in addition mounting supports 16*a*, 16*b* for a closing rail 17 provided, the purpose of which shall be explained. Furthermore the mounting plate 14 of the cassette carriage carrier 8 has an opening 18 through which extends a clamping device 19 which can be manipulated by a hand-lever 20. By activating the hand-lever 20 the cassette carrier carriage 8 can be fixed onto or released from the carrier cheeks 7, so that the cassette carriage carrier 8 can be pivoted away from the device 1 about the pivot shaft 9.

The mounting plate 14 is provided with a further opening 21, through which a nozzle 23 extends, which is bound to the mounting plate 14 by a mounting support clamp 22 and a hinge pin 24. The nozzle 23 has a transfer channel 28 which connects the output of a magazine rod 12 located in a cassette 11 with a magazine channel of the input magazine. A conveyor wheel 25 projected into the transfer channel 28 and together with a light barrier, consisting of a light emitter 26 and a light receiver 27, forms a known separating apparatus. The components 51 coming from a magazine rod are separated by the conveyor wheel 25 and then delivered to a magazine channel of the input magazine 2.

In order to guarantee a clean centering, there is a tongue 29, on the end of the nozzle 23 facing the input magazine 2, which interlocks with a slot 52 on the displaceable input magazine and guarantees that the transfer channel 28 corresponds in height in every case with a magazine channel of the input magazine 2.

On its bottom surface the cassette carriage 10 is provided with a toothed rack 33 which has a large number of toothed grooves 34. There is an eccentric motor 30 for the cassette carriage 10 on the mounting plate 14 of the cassette carriage carrier 8. From this a carrier disk with two eccentric pins 31, 32 is visible, each of these interlocking with a toothed groove 34. This known transport mechanism guarantees an exactly defined indexing of the cassette carriage 10 and in the position of the eccentric pins 31, 32 represented, an automatic locking device against displacement.

On the cassette carriage 10 there are two mounting supports 38, 38*a* for a cassette 11. The mounting support 38 is provided with a cylindrically formed locking element 40 which can interlock with a wedge-shaped locking recess 39 on the cassette 11. The mounting support 38*a* has a two-armed lever 43, one arm of which can be manipulated as a hand-lever and the other arm of which also has a cylindrically formed locking element 42, which interlocks with a corresponding wedge-shaped locking recess 41 of the cassette 11. By pivoting the lever 43 the cassette can be released or stopped.

Figure 3:
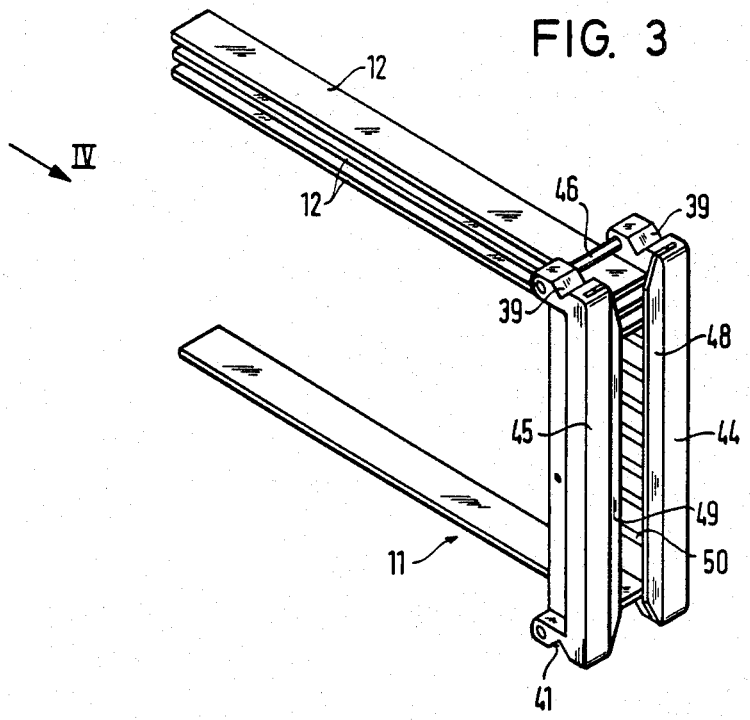
FIG. 3 shows a perspective drawing of the cassette.
Figure 4:
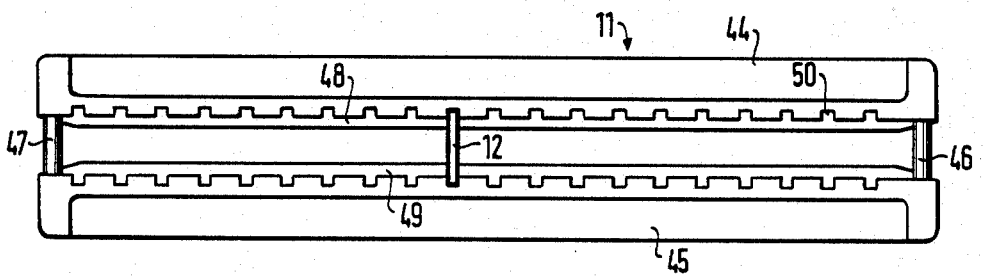
FIG. 4 shows a view of IV—IV from FIG. 3.

In FIGS. 3 and 4 a cassette is represented in more detail. This consists of two side panels 44, 45 which are connected to each other with exchangeable separator pieces 46, 47. By choosing separator pieces of differing lengths the cassette can be used for different magazine rods 12. On the inside the side panels 44, 45 have closing strips 48, 49, which by means of springs (not shown) are pressed inwardly into a closed position and in this way partly seal the outputs of the magazine rods 12 so that no components can exit from the magazine rods 12. Furthermore the side panels 44, 45 have receiving grooves 50 for the magazine rods 12 on their inner side. In this way a multiplicity of magazine rods 12 can be pushed in a parallel fashion into the cassette.

In FIG. 2 the cassette carriage 10 is shown in a position in which there can be no transfer of components from the magazine rods 12 to the input magazine 2 via the nozzle 23. For this it is firstly necessary to displace the cassette carriage 10 on the cassette carriage carrier 8 in a downwards direction. When this displacing downwards takes place then an opening element 37 which is firmly fixed onto the nozzle 23 pushes between the closing strips 48, 49 of the cassette 11 and presses these outwards against the action of the springs. In this way the output opening of the magazine rods 12 is freed for the exit of the components. Components 51 can only exit from a magazine rod 12 which is aligned with the transfer channel 28 of the nozzle 23. The remaining magazine rods 12 which are still full are closed by means of the closing rail 17 described above, which lies in the gap between both closing strips 48, 49 and is firmly connected to the cassette carriage carrier 8. If the cassette carriage 10 continues to be moved to the left those magazine rods 12 of the cassette 11 move out of the area of alignment with the transfer channel 28 as well as away from the area in which they are sealed by the closing rail 17. They are, therefore, not closed. This is of no importance, however, since they no longer contain any components.

As described at the beginning, it is also possible to arrange several cassettes 11 side by side on the cassette carriage 10. The cylindrical locking elements 40 and 42 serve then as guides for a necessary lateral displacement of the cassettes, so that one after the other they are brought into the loading or unloading position respectively. The displacing drive is not illustrated.

In FIGS. 2 to 4 the additional apparatus was described in connection with the input magazine. The function of the attachment with the output magazine is analogous. Here the conveyor wheel 25 of the separating apparatus must only convey in the opposite direction

I claim:

1. Device for testing and sorting electronic components, more particularly those with integrated circuits (IC's), having an input magazine, which has at a first end a plurality of magazine channels arranged parallel to each other and running at an incline, said input magazine having at a second end opposite said first end a testing unit attached to it, and an output magazine which has at a first end a plurality of magazine channels arranged parallel to each other and running at an incline, said testing unit being attached to a second end of said output magazine opposite said first end, characterised in that at said first end of the input magazine and at said first end of the output magazine at least one cassette carriage carrier is arranged with a cassette carriage, said cassette carriage having at least one exchangeable cassette with a large number of exchangeable magazine rods arranged parallel to each other and perpendicular to said cassette carriage, said magazine rods being in the same plane as said magazine channels and parallel to said channels, said cassette carriage being displaceable in a plane perpendicular to said magazine rods and said magazine channels, each cassette consisting of two side panels connected by replaceable separator pieces and provided with grooves for the introduction of the magazine rods, said side panels having displaceable closing strips for the magazine rods which are pressed into a closed position by springs; said cassette carriage carrier having an opening element which pushes itself between the closing strips with movement of the cassette carriage and forces said closing strips apart, said cassette carriage carrier being further provided with a closing rail or plate which, when the closing strips are open, hinders exit or entry of the components from or into the magazine rods except for the magazine rod which is determined for loading or unloading, said cassette carriage carrier also provided with a separating apparatus for the components exiting from or entering into the selected magazine rod, said separating apparatus consisting of a conveyor wheel for the components, and being provided with a light barrier, said cassette carriage carrier being further provided with a nozzle which contains a transfer channel which interlocks with the conveyor wheel and which connects the selected magazine rod of the cassette to the selected magazine channel of a magazine, whereby a side of the nozzle facing a magazine is provided with a tongue which, for the purpose of centering, enters into a recess at the magazine.

2. Device according to claim 1, characterised in that with an input magazine which is displaceable transversely to the longitudinal direction of the magazine channels and arranged in a gas-filled climatic chamber, there is provided in the climatic chamber a minimally small opening to transfer the components from a magazine channel of the input magazine.

3. Device according to claim 2, characterized in that the cassette carriage can be fitted with several cassettes which are arranged side by side and transverse to the direction of movement of said cassette carriage, and that the cassettes are displaceable transversely to the direction of movement of the cassette carriage in order to bring them into the loading or unloading position.

4. Device according to claim 1, characterised in that the cassette carraige can be fitted with several cassettes which are arranged side by side and transverse to its direction of movement, and that the cassettes are displaceable transversely to the direction of movement of the cassette carriage in order to bring them into the loading or unloading position.

5. Device according to claim 1, characterised in that with a stationary output magazine several cassette carriage carriers with cassette carriages, in each case corresponding to a magazine channel, are provided.

6. Device according to claim 1, characterised in that the cassette carriage carrier is pivotally mounted on the device.

7. Device according to claim 1, characterised in that the cassette carriage is provided with a large number of teeth-like recesses, and that serving as a drive for the cassette carriage there is an eccentric pinion with two eccentric pins which interlock with the adjoining recesses in such a way that each time the eccentric revolves an eccentric pin enters a recess and the other exits from a recess.

* * * * *

UNITED STATES PATENT AND TRADEMARK OFFICE

CERTIFICATE OF CORRECTION

PATENT NO. : 4,778,063

DATED : October 18, 1988

INVENTOR(S) : Ekkehard Ueberreiter

It is certified that error appears in the above-identified patent and that said Letters Patent is hereby corrected as shown below:

Column 6, line 9, Claim 2: "magazine channel of the input magazine." should read as --magazine rod of the cassette to a magazine channel of the input magazine.--

Signed and Sealed this

Nineteenth Day of December, 1989

*Attest:*

JEFFREY M. SAMUELS

*Attesting Officer* *Acting Commissioner of Patents and Trademarks*